United States Patent [19]

Nakamura et al.

[11] Patent Number: 4,498,862

[45] Date of Patent: Feb. 12, 1985

[54] DEVICE FOR ADJUSTING THE VERTICAL POSITION OF WICK IN OIL BURNER

[75] Inventors: Kazuharu Nakamura, Nagoya; Yutaka Nakanishi, Kounan, both of Japan

[73] Assignee: Toyotomi Kogyo Co., Ltd., Nagoya, Japan

[21] Appl. No.: 555,727

[22] Filed: Nov. 28, 1983

[30] Foreign Application Priority Data

Nov. 27, 1982 [JP] Japan ..... 57-179545[U]

[51] Int. Cl.[3] ..... F23N 5/24

[52] U.S. Cl. ..... 431/88; 431/301; 431/317; 126/96

[58] Field of Search ..... 431/88, 301, 308, 304, 431/317, 322, 344; 126/95, 96; 222/500, 516; 137/38

[56] References Cited

U.S. PATENT DOCUMENTS 3,279,524 10/1966 Nozaki et al. ..... 126/96 X

FOREIGN PATENT DOCUMENTS 137736 10/1979 Japan ..... 431/301
129535 10/1979 Japan ..... 431/88
142630 11/1979 Japan ..... 431/88

*Primary Examiner*—Randall L. Green
*Attorney, Agent, or Firm*—Pollock, Vande Sande & Priddy

[57] ABSTRACT

A device for adjusting the vertical position of a wick in an oil burner is disclosed which is capable of keeping the lowermost position of the wick constant irrespective of the variably set uppermost position thereof. The device comprises a stopper forced by a spring against a gear fitted on a wick operating shaft, the gear being adapted to be rotated with the shaft to wind a return spring for the gear when the shaft is rotated to move the wick upwardly. A control member is fitted on the shaft and provided with a stopper actuating portion which moves the stopper against the spring means to release the engagement between the stopper and the gear. The control member is adapted to be engaged with the shaft and the gear at a desired position, and the shaft is reversed by the return spring when the stopper is moved to be disengaged from the gear.

9 Claims, 3 Drawing Figures

DEVICE FOR ADJUSTING THE VERTICAL POSITION OF WICK IN OIL BURNER

BACKGROUND OF THE INVENTION

1. Field of the Invention

This invention relates to a device for adjusting the vertical position of a wick in an oil burner wherein a return spring causes a wick operating shaft to be automatically rotated to move the wick downwardly. More particularly, the invention relates to a wick adjusting device which is adapted to variably set the uppermost position of the wick as desired by means of a control member rotated with a gear and yet to keep the fire extinguishing position of the wick constant, irrespective of the variable uppermost position of the wick, when the wick is manually downwardly moved while the return spring is wound up.

2. Description of the Prior Art

A mechanism for vertically moving a wick in an oil burner has been known in the art as disclosed in U.S. Pat. No. 4,363,620 issued to Nakamura et al on Dec. 14, 1982. In this mechanism, a pinion provided at one end of a wick operating shaft is engaged with a rack means integrally mounted with respect to a wick to vertically move the wick. Any change in the set uppermost position of a wick necessarily causes a change in the fire extinguishing position thereof. Thus, the mechanism has a disadvantage that it is substantially impossible to keep the fire extinguishing position of a wick constant irrespective of the uppermost position thereof.

BRIEF SUMMARY OF THE INVENTION

The present invention has been made in view of the foregoing disadvantage of the prior art.

Accordingly, it is an object of the present invention to provide a device for adjusting the vertical position of a wick in an oil burner which is capable of keeping the fire extinguishing position of a wick constant irrespective of the variable uppermost position thereof, to effectively and rapidly carry out fire-extinguishing of the oil burner.

It is another object of the present invention to provide a device for adjusting the vertical position of a wick in an oil burner which is capable of the above-mentioned object with a simple structure and a low cost.

It is a further object of the present invention to provide a device for adjusting the vertical position of a wick in an oil burner which is capable of effectively automatically accomplishing rapid fire-extinguishing in an emergency such as earthquake as well as accomplishing the above-mentioned objects.

It is still a further object of the present invention to provide a device for adjusting the vertical position of a wick in an oil burner which is capable of effectively carrying out rapid fire-extinguishing in an emergency manually as well as automatically.

In accordance with the present invention, there is provided a device for adjusting the vertical position of a wick in an oil burner comprising a wick operating shaft rotated to vertically move the wick; a gear loosely fitted on the wick operating shaft and having a return spring; a stopper means forced toward the gear by a spring means to be engaged with the gear; the gear being rotated with the wick operating shaft to wind the return spring when the wick operating shaft is rotated to upwardly move the wick; the wick operating shaft being reversed by the return spring when the stopper is moved to be disengaged from the gear; and a control member loosely fitted on the wick operating shaft and provided with a stopper actuating portion which moves the stopper means against the spring means to release the engagement between the stopper means and the gear, the control member being adapted to be engaged with the wick operating shaft and the gear at a desired position.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate the same parts throughout; wherein.

DETAILED DESCRIPTION OF THE PREFERRED EMBODIMENT

Now, a device for adjusting the vertical position of a wick in an oil burner according to the present invention will be described hereinafter with reference to the accompanying drawings.

Figure 1:
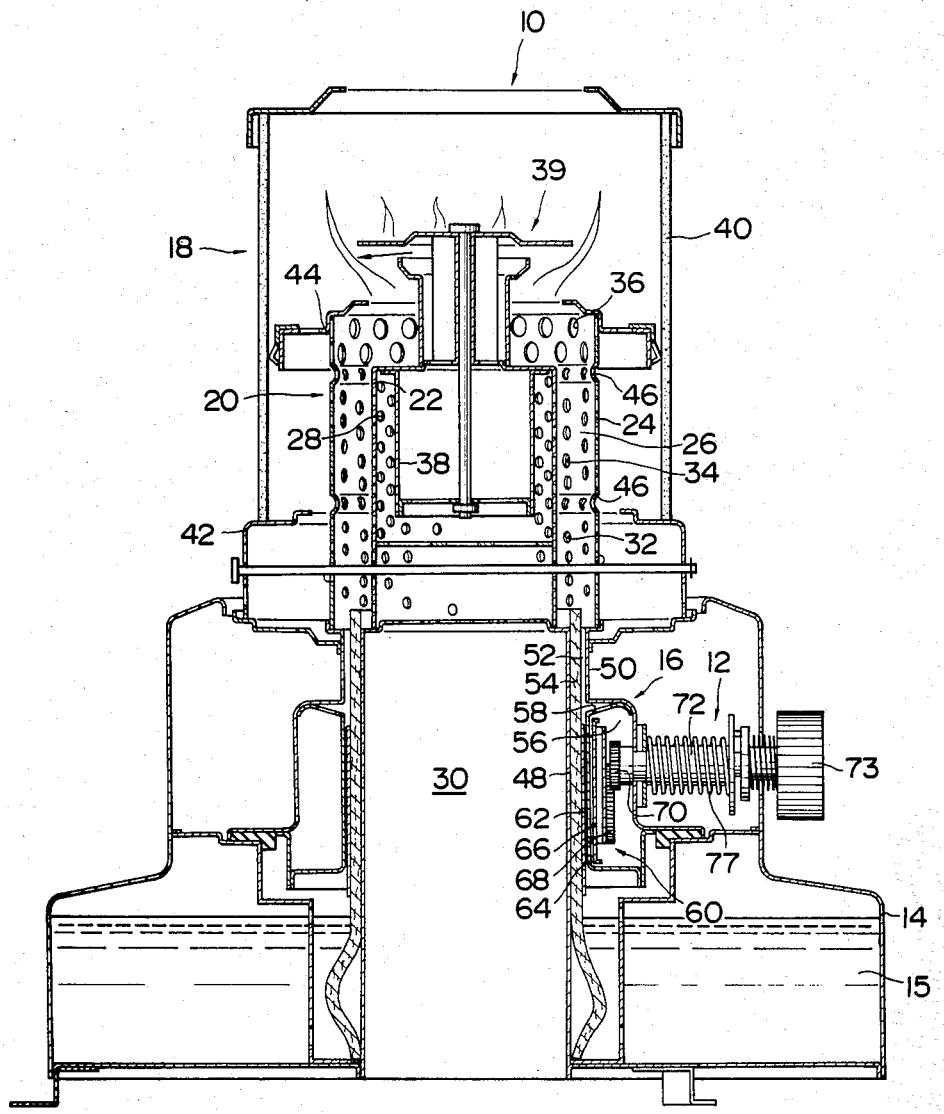
FIG. 1 is a vertical sectional view showing an oil space heater of the red hot type which comprises an embodiment of a device for adjusting the vertical position of a wick in an oil burner according to the present invention.

Referring now to FIG. 1, there is schematically illustrated an oil burner 10 which is adapted to incorporate therein a device for adjusting the vertical position of a wick according to the present invention. The device of the invention is generally indicated by reference numeral 12. The oil burner illustrated in FIG. 1 is a red-hot type oil-fired space heater. However, it should be noted that an oil burner in which the wick adjusting device of the present invention is to be incorporated is not limited to such oil-fired space heater.

The oil burner 10 illustrated in FIG. 1 is constructed in such a manner as widely known in the art, except the wick adjusting device 12 of the present invention incorporated therein. The oil burner 10 comprises an oil tank 14 for storing therein fuel oil 15 such as kerosene, a wick receiving cylinder 16 positioned on the tank 14 and a combustion cylinder construction 18 disposed on the wick receiving cylinder 16.

The combustion cylinder construction 18 includes a double combustion cylinder 20 comprising an inner cylindrical member 22 and an outer cylindrical member 24 arranged to have a space 26 defined therebetween. The inner member 22 is provided with a plurality of through-holes 28 which serve to introduce a part of combustion air from the lower portion of an internal cylindrical space 30 defined in the heater therethrough to the space 26. The outer cylindrical member 24 is also provided with a plurality of lower, middle and upper through-holes 32, 34 and 36. The upper and middle through-holes 34 and 36 are formed to have a size larger than the through-holes 28 of the inner cylindrical member 22. The inner cylindrical member 22 has a central cylinder 38 disposed therein, on which a flame spreading means 39 is mounted. The combustion cylinder construction 18 also includes a heat-permeable cylinder 40 supported through a non-permeable cylinder 42 on the wick receiving cylinder 16. The outer cylindrical member 24 is provided at the upper portion thereof with an annular top plate 44 which horizontally extends to the heat-permeable cylinder 40. The outer cylindrical member 24 also has recesses 46 of a semi-circle in section provided circumferentially at the boundary portions between the lower through-holes 32 and the middle through-holes 34 and between the middle through-holes 34 and the upper through-holes 36. The recesses 46 each are provided with a plurality of through-holes.

The wick receiving cylinder 16 may be constructed in such a manner as disclosed in U.S. Pat. No. 4,363,620 issued to Nakamura et al on Dec. 14, 1982. The wick receiving cylinder 16 has an inner wall 48 and an outer wall 50 which define therebetween an annular chamber 52 for receiving a wick 54 communicated to the space 26 between the inner and outer cylindrical members 22 and 24. When combustion is to be carried out, the wick 54 is raised to the lower portion of the space 26 as shown in FIG. 1. The wick receiving chamber 52 is provided therearound with an annular air chamber 56 having an annular opening 58 through which the air chamber 56 is communicated to the wick receiving chamber 52. Reference numeral 60 designates a wick actuating means for vertically moving the wick 54 supported on an annular retaining plate 62 which is disposed between the wick 54 and a lower wall member 64 of the outer wall 50 of the cylinder 16 to lightly press the wick against the inner wall 48 of the chamber 52. The wick actuating means 60 may be constructed in a manner as known in the art and comprises an annular plate 66 for rotating the wick retaining plate 62. Plate 66 is arranged at the outside of the outer wall 50 of the wick receiving chamber 52 and is adapted to circumferentially move. A rack 68 is mounted on the plate 66 and a pinion 70 is provided at one end of a wick operating shaft 72 so as to engage with the rack 68. The connection between the wick retaining plate 62 and the actuating plate 66 may be effected by means of a suitable conventional means such as a connecting pin (not shown).

Figure 2:
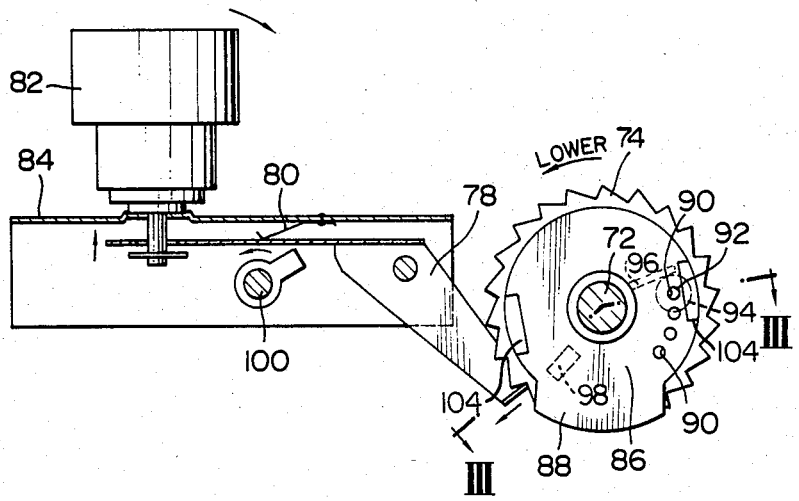
FIG. 2 is a schematic view showing the essential parts of a device for adjusting the vertical position of a wick in an oil burner according to the present invention, the parts being illustrated as they appear when the wick has been raised to its maximum vertical position shown in FIG. 1.
Figure 3:
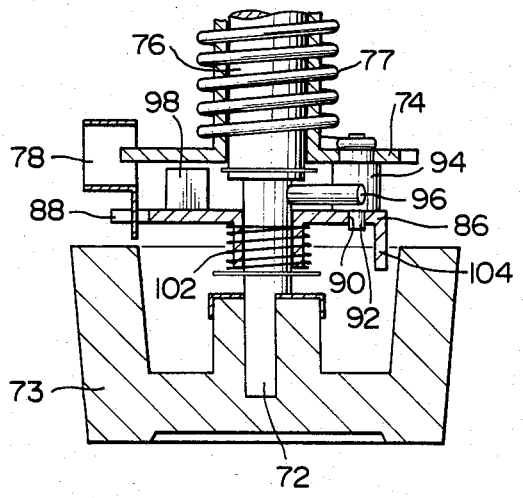
FIG. 3 is a sectional view taken along line III—III of FIG. 2.

The wick adjusting device 12 of the present invention is provided about the wick operating shaft 72 having a knob 73 provided at the other end thereof which acts to rotate the shaft 72. The wick adjusting device 12, as schematically shown in FIG. 1 and detailedly shown in FIGS. 2 and 3, includes a gear 74 freely fitted on the wick operating shaft 72. The components of wick adjusting device 12 are shown in the positions they assume when the wick has been raised to its maximum vertical position. In the embodiment illustrated, the gear 74 is loosely fitted on a sleeve 76 of the shaft 72. The device 12 also includes a return spring 77 fixedly interposed between a burner body and the gear 74. In the embodiment illustrated, the return spring 77 comprises a coiled spring fitted on an axially extending sleeve portion of the gear 74. Reference numeral 78 designates a pivoted stopper means which acts at its one end to engage with the gear 74 to stop rotation of the gear 74. The stopper 78 is constantly forced at one end thereof against the gear 74 by a spring 80 to engage with the gear. In the illustrated embodiment, the spring 80 comprises a leaf spring. The stopper 78 is connected at its other end to a vibration sensing wieght 82 arranged on a horizontal support 84 in a manner such that the stopper 78 is upwardly moved at its other end by the weight 82 when the weight is vigorously vibrated or tilted. As a result, stopper 78 becomes disengaged from the gear 74. The wick operating shaft 72 has also loosely fitted thereon a circular control member 86, which is positioned between the gear 74 and the knob 73. Control member 86 comprises a radially extending projection 88 at a part of the periphery thereof, projection 88 being positioned to engage the one end of the stopper 78 to release the engagement between the stopper 78 and the gear 74 against the spring 80. The control member 86 has a plurality of small through-holes 90 formed in the circumferential direction thereof. Any one of the through-holes 90 may be fitted with a pin-like projection 92 of a rod 94 which is mounted on the gear 74 so as to extend toward the knob 73. Alternatively, the embodiment may be constructed in such a manner that the rod 94 is mounted on the control member 86 and the gear 74 is provided with the through-holes 90. The wick operating shaft 72 is provided with a radially outwardly extending pin member 96. The pin member 96 serves to press the rod 94 to rotate the gear 74 with the wick operating shaft 72, to thereby wind the spring 77, when the shaft 72 is rotated in the direction to move the wick 54 upwardly, or clockwise to the maximum vertical position for the wick, as illustrated in FIG. 2. The stopper 78 engages with the gear 74 to prevent the gear from being reversed due to wound spring 77, to thereby keep spring 77 in a wound state.

The control member 80, as described above, acts to press the stopper 78 to disengage the stopper from the gear 74, when the peripheral projection 88 contacts with or abuts against the stopper 78. Thus, it will be noted that rotation of the wick operating shaft 72 in the illustrated counterclockwise direction to move the wick 54 upwardly causes rotation of the control member 86 as well as rotation of the gear 74 and winding of the spring 77 through the pin member 96 and rod 94. When the member 86 is rotated for enough to permit the peripheral projection 88 to abut against the stopper 78, the stopper is disengaged from the gear 74, thereby allowing both member 86 and gear 74 to be reversed by wound spring 77 if the knob 73 is released, until the stopper 78 engages with a tooth of the gear which first appears when the peripheral projection 88 of the control member 86 terminates or goes past stopper 78. In the following discussion, this point of engagement of the stopper 78 and the gear 74, with the wick in its uppermost selected position, is referred to as the "engaged "position" of the stopper and gear. Of course the wick operating shaft 72 is caused to reverse direction at the same time, if knob 73 is released while projection 88 has disengaged stopper 78. Thus, in such state, when the shaft 72 is rotated to move the wick 54 upwardly, the release of the shaft 72 from hand allows the shaft to be reversed until stopper 78 engages with gear 74, resulting in the wick 54 descending to a predetermined or constant vertical engaged position. The predetermined vertical position of the wick is variably determined depending upon the through-holes 90 of the control member 86 in which the pin-like projection 92 of the rod is to be fitted.

Reference numeral 98 designates a projection provided on the control member 86 so as to extend toward the gear 74. The projection 98 serves to determine the fire extinguishing position of the wick 54 in the case that it is manually lowered from the position shown in FIG. 2. More particularly, when the wick operating shaft 72 manually reversed to lower the wick 54 while keeping the engagement between the gear 74 and the stopper 78 to keep return spring 77 wound up, the pin member 96 is moved away from the rod 94 of the gear and is stopped at a constant, lower position by abutting against the projection 98.

The illustrated embodiment may include a manual operating handle 100 provided adjacent to the stopper 78 as shown in FIG. 2, which acts to operate the stopper 78 to release the gear 74 and the stopper 78 from their engaged position as desired when the vibration sensing weight 82 is not vibrated or tilted. The control member 86 may be forced toward the gear 74 by means of a spring means 102 to prevent the pin-like projection 92 of the rod 94 from being disengaged from the hole 90 of the member 86. The control member 86 may be also provided with a handle 104. When the handle 104 is pulled after removing the knob 73, fitting of the projection 92 in the through-hole 90 is released to allow the projection 92 to be selectively fitted in any one of the remaining through-holes 90.

In the device for adjusting the vertical position of a wick of the present embodiment constructed in the manner as described above, the peripheral projection 88 of the control member 86 may be variably positioned with respect to the gear 74 as desired by pulling outward on the handle 104, letting stopper 58 hold gear 74 steady in the position illustrated in FIG. 2 and then rotating member 86 to selectively insert the pin-like projection 92 of the rod 94 into any one of the small through-holes 90. This allows the engaged position of the gear with respect to the stopper 78 to be changed as desired, so that the uppermost position of the wick may be set as desired. Such variable setting of uppermost position of the wick may be also understood by the fact that the direction of the pin member 96 with respect to a certain vertical position of the wick is varied depending upon selection of the through-holes 90.

Also, the embodiment is constructed in the manner that the pin member 96 of the wick operating shaft 72 abuts against the projection 98 of the control member 86 when the shaft 72 is reversed manually from the maximum vertical position of the wick, to thereby stop further reverse of the shaft 72. This allows the wick to be manually lowered to a constant fire extinguishing position irrespective of selection of the through-holes. The reason is that even when pin member 96 is moved to a different through-hole 90, the stopper 78 remains in the same position adjacent to the gear 74. Also, the relationship in the engaged position between the stopper and the gear, with respect to the position of the control member 86 when spring 77 is wound up, is constant irrespective of the chosen combination of through-holes 90 and pin-like projection 92. So, when spring 77 unwinds to rotate gear 74, in reverse to the engaged position, the stopper 78 necessarily engages with the tooth of the gear first appearing when the peripheral projection 88 of the member 86 terminates or goes past, irrespective of any combination between the through-holes 90 and the pin 92. Also, the projection 98 of the member 86 has the same positional relationship to the stopper 78 in the engaged position; therefore, the pin member 96 is positioned in the same direction when the wick is lowered manually to the fire extinguishing position, so that the lowermost position of the wick following manual lowering is constant irrespective of the setting of uppermost position of the wick.

As can be seen from the foregoing, the present invention is capable of carrying out the adjusting of uppermost position of the wick and the setting of fire extinguishing position of the wick utilizing only the relationship between the gear and the control member, thus, the device of the present invention may be very readily operated and manufactured with ease and at a low cost. Thus, it will be readily understood that the disadvantage of the prior art that the re-adjustment of uppermost position of a wick necessarily causes the variation of fire extinguishing position of the wick to render the fire-extinguishing operation of a burner troublesome may be effectively eliminated.

While a preferred embodiment of the invention have been described with a certain degree of particularity, obvious modifications and variations are possible in light of the above teachings. It is therefore to be understood that within the scope of the appended claims, the invention may be practiced otherwise than as specifically described.

What is claimed is:

1. A device for adjusting the vertical position of a wick in an oil burner, comprising:

a burner body;

a wick operating shaft mounted on said body and adapted to be rotated to vertically move such a wick;

a gear loosely fitted on said wick operating shaft and having a return spring connected between said gear and said body;

a stopper means mounted on said body and forced by a spring means toward said gear to be engaged with said gear;

means connected between said wick operating shaft and said gear for rotating said gear with said wick operating shaft to wind said return spring when said wick operating shaft is rotated to move such a wick upwardly and for reversing said wick operating shaft as said return spring unwinds when said stopper means is moved to be disengaged from said gear;

a control member loosely fitted on said wick operating shaft and provided with a stopper actuating portion for moving said stopper means against said spring means to release the engagement between said stopper means and said gear; and means for engaging said control member with said wick operating shaft and said gear at a desired position.

2. A device for adjusting the vertical position of a wick in an oil burner as defined in claim 1, wherein said means for rotating and reversing comprises a pin member extending outwardly from said wick operating shaft and said gear is provided with a projection, said pin member of said wick operating shaft being pressedly engaged with said projection of said gear to rotate said wick operating shaft and said gear together to wind said return spring when said wick operating shaft is rotated to upwardly move said wick.

3. A device for adjusting the vertical position of a wick in an oil burner as defined in claim 2, wherein said control member is provided with a plurality of through-holes, said projection of said gear being selectively fittedly engaged with any one of said through-holes as desired.

4. A device for adjusting the vertical position of a wick in an oil burner as defined in claim 3, wherein said control member is provided with a projection means for engaging said pin member of said wick operating shaft to stop further reverse movement of said wick operating shaft when said shaft is reversed.

5. A device for adjusting the vertical position of a wick in an oil burner as defined in claim 1, wherein said stopper means is pivotally mounted on said body and engages said gear at one end, further comprising a vibration sensing weight to which the other end of said stopper means is connected so that the engagement between the one end of said stopper means and said gear is released when said vibration sensing weight is vibrated or tilted.

6. A device for adjusting the vertical position of a wick in an oil burner as defined in claim 1 further comprising means for manually releasing the engagement between said stopper means and said gear as desired.

7. A device for adjusting the vertical position of a wick in an oil burner as defined in claim 3, wherein said control member is interposed between said gear and a knob attached to said wick operating shaft and is forced toward said gear by means of a spring.

8. A device for adjusting the vertical position of a wick in an oil burner as defined in claim 7, wherein said control member is provided with a handle means extending therefrom toward said knob, said handle means facilitating the selective fitting of said projection with respect to any one of said through-holes when said handle is pulled to move said control member relative to said wick operating shaft.

9. A device for adjusting the vertical position of a wick in an oil burner, comprising:

a burner body;

a wick operating shaft mounted on said body and adapted to be rotated to vertically move such a wick, said wick operating shaft being provided with a pin member extending outwardly therefrom;

a gear loosely fitted on said wick operating shaft and having a return spring mounted thereon and connected between said gear and said body, said gear being provided with a projection;

said pin member of said wick operating shaft being pressedly engaged with said projection of said gear to rotate said wick operating shaft and said gear together to wind said return spring when said wick operating shaft is rotated to upwardly move said wick;

a stopper means mounted on said body and forced by a spring means toward said gear to be engaged with said gear;

said wick operating shaft being reversed by said return spring when said stopper means is moved to be disengaged from said gear;

a control member loosely fitted on said wick operating shaft and provided with a stopper actuating portion for moving said stopper means against said spring means to release the engagement between said stopper means and said gear; and means for engaging said control member with said wick operating shaft and said gear at a desired position.

* * * * *